United States Patent [19]

Thompson

[11] 4,276,791

[45] Jul. 7, 1981

[54] DISTRIBUTOR RATCHET WRENCH

[76] Inventor: John W. Thompson, 951 Mikael Ave., Jacksonville, Fla. 32205

[21] Appl. No.: 44,599

[22] Filed: Jun. 1, 1979

[51] Int. Cl.[3] ..... B25B 13/46

[52] U.S. Cl. ..... 81/62; 81/63.1

[58] Field of Search ..... 81/60–63.2, 81/185

[56] References Cited

U.S. PATENT DOCUMENTS

| | | | |
|---|---|---|---|
| 754,069 | 3/1904 | Johnson | 81/63.2 |
| 755,293 | 3/1904 | George | 81/63.2 |
| 1,413,243 | 4/1922 | Thompson | 81/63.1 |
| 2,337,368 | 12/1943 | Bohler | 81/185 |
| 2,651,230 | 9/1953 | Waterval | 81/185 |

*Primary Examiner*—James L. Jones, Jr.
*Attorney, Agent, or Firm*—Arthur G. Yeager

[57] ABSTRACT

A ratchet wrench attached to an offset vertically elongated handle with the control for operating the ratchet on the upper extremity of the handle. This wrench finds important use in loosening and tightening the clamp nut of a distributor when adjusting the timing on an internal combustion engine.

1 Claim, 3 Drawing Figures

DISTRIBUTOR RATCHET WRENCH

BACKGROUND OF THE INVENTION

It has become necessary to design internal combustion engines more compactly in order that the vehicle carrying the engine may be as small as possible for its intended purpose. This accomplishes a saving in space and a saving in weight as well as a corresponding saving in fuel consumption. With each new design of smaller engines and smaller bodies it has become necessary to design new tools that are small enough and of the proper design to be used in the space provided.

Two ways in which this problem of working in small spaces has been met are (1) the use of offset handles and (2) the use of ratchet wrenches. While these tool modifications have provided solutions to some of the problems they have not been successful in other problems. For example, in the adjustment of timing of a distributor on an internal combustion engine it is necessary to loosen a clamp nut near the base of the distributor under an overhanging portion, followed by adjustment of the timing and then tightening the clamp nut to lock the timing mechanism in that position. When an end wrench is used, which has an offset, the nut can be turned only a small portion of a revolution, and then the wrench must be removed repositioned and again turned a portion of a revolution, and so on until sufficient loosening has been accomplished. If a ratchet wrench is employed, either of two problems is encountered. If the normal ratchet wrench is used there usually is insufficient space to permit a ratchet and a socket adapter to be used and no room to move the wrench handle, and furthermore, the control means for the ratchet is normally near the socket, which is not in a convenient location for the operator to change the setting. If some type of offset extension is employed, the ratchet mechanism is located near the upper extremity of the offset, which means that the wrench can only be turned a partial revolution and then is removed and replaced for another partial turning as with an end wrench. In so far as is known, there is no socket wrench available in which the ratchet head can be placed on a remote nut or bolt and turned in either direction without removing the socket from the nut or bolt, and without the necessity of reaching into the cramped quarters near the nut or bolt to change the direction of rotation of the ratchet mechanism.

It is an object of the present invention to provide a ratchet wrench which will serve these purposes, and more particularly one which can be used on the clamp nut of a distributor when the timing is to be adjusted. The wrench of this invention is placed on the nut or bolt one time only, and the direction of its rotation can be controlled from the convenient handle which is remote from the ratchet head.

BRIEF SUMMARY OF THE INVENTION

This invention relates to a ratchet wrench for use in tightening or loosening nuts or bolts in remote locations which are difficult to reach and which may have space limitations, the wrench comprising a socket wrench head capable of rotating with a ratchet movement clockwise or counterclockwise or of being locked to prevent ratchet movement, a generally horizontal extension from the wrench head, a generally vertical extension connecting at its lower extremity with said horizontal extension, a generally horizontal handle extension connected to the upper extremity of the vertical extension, and a remote control switch on one of said extensions for selectively controlling the direction of rotation with ratchet movement or the locking to prevent ratchet movement. In a specific application the wrench of this invention is employed to tighten or loosen the clamp nut of the distributor of an internal combustion engine.

DETAILED DESCRIPTION OF THE INVENTION

Figure 1:
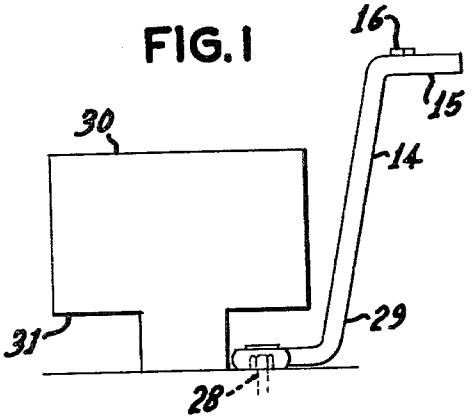
FIG. 1 is a schematic illustration of the wrench of this invention employed on the clamp nut of a distributor.

With reference to FIG. 1 there is shown a distributor head 30 on an internal combustion engine. In order to adjust the timing of the engine it is necessary to loosen the clamp nut 28 of the distributor in order to set the timing of the engine to the desired adjustment, following which nut 28 must be tightened in order to lock the timing adjustment in its setting. In most instances, clamp nut 28 is located under an overhanging portion 31 of distributor head 30 and this fact in addition to the nearness of other engine parts makes the timing adjustment a difficult matter to accomplish easily. If an ordinary end wrench is employed it can normally be used to turn the nut only a portion of a revolution before the wrench must be removed and replaced again in order to make a second partial revolution. A normal ratchet head wrench with a socket adapter is too large to be used in the cramped space. Even if a small one were available it would suffer from the disadvantage of having not enough space to move the wrench handle, and it would also present the problem of reaching the control button in the cramped space near the wrench head.

Wrench 29 is shown as having a socket insert that is as thin as possible in the vertical direction, i.e. not more than about 0.5 to 1.0 inch, and the remainder of the wrench is built in an offset S-orZ- shape so that the socket head can be placed under overhanging portion 31 and handle 15 will be above the distributor and removed from interference with nearby engine parts. Ratchet control 16 is located in any convenient place, e.g. on handle 15, and can be operated to cause the ratchet to rotate to the right or to the left or the control can be positioned so as to prevent any ratchet action at all. In this third controlled position the wrench functions as an ordinary end wrench having no ratchet movement.

Figure 2:
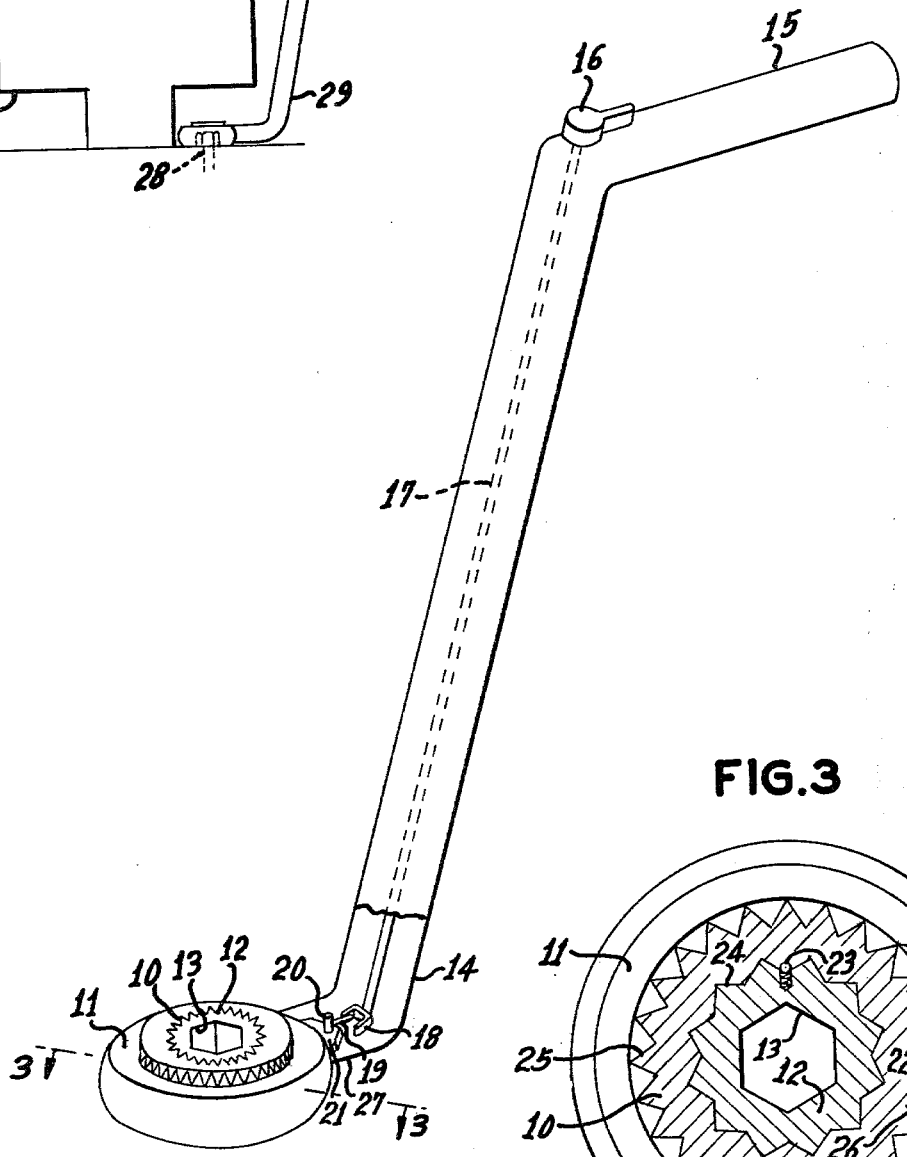
FIG. 2 is a perspective view of the wrench of this invention.
Figure 3:
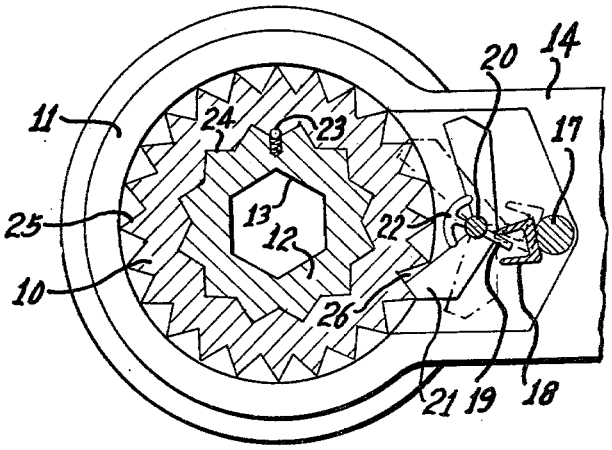
FIG. 3 is a cross sectional view through the head of the wrench taken at line 3—3.

In FIGS. 2 and 3 the details of the wrench can be seen. The wrench is comprised of an outer housing 11, and inner ratchet ring 10, and a removable socket 12 having a bore 13 which may be any of several sizes of hexagons squares, or other shapes to fit the bolts and nuts expected to be encountered. In the preferred embodiment socket 12 is snapped in and out of ratchet ring 10 and held in position by a suitable spring biased ball-and-socket fitting 23. It is contemplated, however, that within the scope of this invention are ratchet wrenches that have a single socket that is not manually removable. The fitting between ratchet ring 10 and socket 12 is shown as a twelve-point fluting. This design is not critical and it is to be understood that any other arrangements suitable for socket head wrenches is acceptable in this invention.

The outside of ratchet ring 10 is fashioned with a series of ratchet teeth 25 which cooperate with pawl 21. Pawl 21 is rotatable about shaft 20 into three positions, one of which is shown FIG. 3. In the position shown ratchet ring 10 can turn in a clockwise direction relative to housing 11 but when housing 11 is moved in a clockwise direction pawl 21 catches in one of teeth 25 and forces ring 10 to move in the same direction clockwise with housing 11, i.e. without any relative movement between ring 10 and housing 11. When pawl 21 is rotated in a counterclockwise direction by turning shaft 20 in that direction, the tip at the other end of pawl 21 will engage teeth 25 to cause exactly the opposite ratchet movement with respect to movement of housing 11. When pawl 21 is rotated to a point halfway in between these two extremes both of the tips of pawl 21 engage teeth 25 and prevent any ratchet action causing ring 10 to have no relative movement with respect to housing 11, i.e. the wrench functions as though it were a solid end wrench without any ratchet action. Pawl 21 is attached to shaft 20 with a small amount of rotational play between pawl 21 and shaft 20 so that the normal ratchet action can occur. Spring 22 is biased against the rotational play of pawl 21 with respect to shaft 20. This serves the purpose of permitting tip 26 to move out of engagement with one of teeth 25 as ring 10 is rotated in a clockwise direction and then to snap back into engagement when rignt 10 has been rotated far enough for tip 26 to fall into the next tooth. This provides the usual clicking noise which is common to the ratchet action of such wrenches.

A control button 16 on handle 15 is remote from ratchet ring 10 so as to provide easy manipulation of the control. This mechanism involves pin 19 which is rigidly fixed to shaft 20 and cooperates with fork 18 which is rigidly fixed to rod 17. Rod 17, in turn, is rigidly connected to button 16. As button 16 is pushed to the right or to the left that action is transmitted to fork 18 which in turn applies corresponding movement to pin 19, and thereby to shaft 20 and to pawl 21. It is not critical that the particular mechanical action suggested here be employed to connect control button 16 with pawl 21. Other alternative mechanisms employing wires, gears, etc. can accomplish the same purpose which is merely to provide a remote control button on handle 15 which is connected to vertical extension 14, the lower extremity of which is connected to housing 11 by a short horizontal extension 27. Preferably, vertical extension is 6–12 inches in length, although longer or shorter lengths are intended to be covered in this invention. Horizontal extension is as short as possible, preferably less than 1 inch. Handle 15 can be any convenient length, preferably 3–6 inches.

While the invention has been described with respect to certain embodiments, it will be appreciated that many modifications and changes may be made by those skilled in the art without departing from the spirit and scope of the invention. It is intended therefore by the appended claims to cover all such modifications and changes as fall within the true spirit and scope of the invention.

What is claimed as new and what is desired to secure by Letters Patent of the United States is:

1. A ratchet wrench for use in tightening or loosening nuts or bolts in remote locations which are difficult to reach, said wrench comprising a socket wrench head, and a ratchet means mounted on said head capable of rotating said head with a ratchet movement clockwise or counterclockwise and capable of being locked to prevent ratchet movement of said head, a generally horizontal member connected to and extending laterally from said wrench head, means mounted on said horizontal member to engage and disengage said ratchet means, a generally elongated vertical extension connected at its lower extremity to said horizontal extension, a generally horizontal handle extension connected to the upper extremity of said vertical extension, and a control means having a control element on one of said extensions remote from said wrench head and closely adjacent to the upper extremity for selectively controlling the direction of rotation of ratchet movement or the locking to prevent ratchet movement, said control means including a control knob adjacent said upper extension and a vertical element extending substantially the length of said vertical extension and operatively connecting between said control knob and said means mounted on said horizontal member thereby controlling said ratchet means, said horizontal member and both of said extensions form a Z-shaped handle and support for said wrench head, said wrench head being adapted to fit the clamp of a distributor of a internal combusion engine and said vertical extension locating said handle extension above the top of said distributor for ready selection between the ratchet positions without removal of said wrench head from said clamp.

* * * * *